US011302464B2

(12) United States Patent
Goto et al.

(10) Patent No.: US 11,302,464 B2
(45) Date of Patent: Apr. 12, 2022

(54) METHOD FOR PRODUCING CHIP VARISTOR AND CHIP VARISTOR

(71) Applicant: TDK CORPORATION, Tokyo (JP)

(72) Inventors: Satoshi Goto, Tokyo (JP); Naoyoshi Yoshida, Tokyo (JP); Takeshi Yanata, Tokyo (JP); Takeshi Oyanagi, Tokyo (JP); Daiki Suzuki, Tokyo (JP); Shin Kagaya, Tokyo (JP); Masayuki Uchida, Tokyo (JP); Yusuke Imai, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 17/230,100

(22) Filed: Apr. 14, 2021

(65) Prior Publication Data

US 2021/0327616 A1 Oct. 21, 2021

(30) Foreign Application Priority Data

Apr. 16, 2020 (JP) ..... JP2020-073502

(51) Int. Cl.
*H01C 7/10* (2006.01)
*H01C 7/102* (2006.01)
*H01C 7/108* (2006.01)

(52) U.S. Cl.
CPC ..... *H01C 7/1006* (2013.01); *H01C 7/102* (2013.01); *H01C 7/108* (2013.01)

(58) Field of Classification Search
CPC ..... H01C 7/1006; H01C 7/102; H01C 7/12; H01C 7/112; H01C 7/108
See application file for complete search history.

(56) References Cited

U.S. PATENT DOCUMENTS 4,290,041 A * 9/1981 Utsumi ..... H01C 7/102 338/21
5,075,665 A * 12/1991 Taira ..... H01C 7/102 338/21
5,119,062 A * 6/1992 Nakamura ..... H01C 7/10 338/20
5,324,986 A * 6/1994 Ueno ..... H01C 7/112 257/701
6,147,587 A * 11/2000 Hadano ..... H01C 7/10 338/21

(Continued)

FOREIGN PATENT DOCUMENTS

JP 2007-013215 A 1/2007

*Primary Examiner* — Kyung S Lee
(74) *Attorney, Agent, or Firm* — Oliff PLC

(57) ABSTRACT

A chip varistor includes an element body exhibiting varistor characteristics, internal electrodes containing a first electrically conductive material, and an intermediate conductor containing a second electrically conductive material. The intermediate conductor is separated from the internal electrodes in a direction in which the internal electrodes oppose each other, and is disposed between the internal electrodes. At least a part of the intermediate conductor overlaps the internal electrodes in the direction in which the internal electrodes oppose each other. The element body includes a low resistance region in which the second electrically conductive material is diffused. The low resistance region is located between the first and second internal electrodes in the direction in which the first and second internal electrodes oppose each other.

8 Claims, 10 Drawing Sheets

(56) References Cited

U.S. PATENT DOCUMENTS

| | | | | |
|---|---|---|---|---|
| 6,184,769 | B1 * | 2/2001 | Nakamura | H01C 7/112<br>338/21 |
| 2006/0220780 | A1 * | 10/2006 | Matsuoka | H01C 7/12<br>338/21 |

* cited by examiner

*Fig.9*

| | NUMBER OF INTERMEDIATE CONDUCTORS | FIRST DISTANCE (μm) | AREA RATIO | Al CONTENT OF INTERNAL ELECTRODE (atm%) | Al CONTENT OF INTERMEDIATE CONDUCTOR (atm%) | ESD RESISTANCE (kV) | ENERGY RESISTANCE (J) | EVALUA-TION |
|---|---|---|---|---|---|---|---|---|
| EXAMPLE 1 | 1 | 0 | 1 | 0 | 0. 1 | 22 | 0. 06 | A |
| EXAMPLE 2 | 1 | 0 | 1 | 0 | 0. 5 | 30 | 0. 06 | A |
| EXAMPLE 3 | 1 | 0 | 1 | 0 | 1 | 30 | 0. 06 | A |
| EXAMPLE 4 | 1 | 0 | 1 | 0 | 3 | 24 | 0. 05 | A |
| EXAMPLE 5 | 1 | 0 | 1 | 0 | 5 | 22 | 0. 03 | A |
| EXAMPLE 6 | 1 | 0 | 1 | 0 | 0. 5 | 30 | 0. 06 | A |
| EXAMPLE 7 | 1 | 40 | 0. 74 | 0 | 0. 5 | 28 | 0. 06 | A |
| EXAMPLE 8 | 1 | 80 | 0. 5 | 0 | 0. 5 | 24 | 0. 04 | A |
| EXAMPLE 9 | 1 | 0 | 1 | 0 | 0. 5 | 30 | 0. 06 | A |
| EXAMPLE 10 | 2 | 0 | 1 | 0 | 0. 5 | 30 | 0. 06 | A |
| EXAMPLE 11 | 3 | 0 | 1 | 0 | 0. 5 | 30 | 0. 06 | A |
| EXAMPLE 12 | 1 | 0 | 1 | 0. 5 | 1. 0 | 26 | 0. 05 | A |
| EXAMPLE 13 | 1 | 0 | 1 | 0. 5 | 0. 5 | 22 | 0. 04 | A |

*Fig.10*

| | NUMBER OF INTERMEDIATE CONDUCTORS | FIRST DISTANCE (μm) | AREA RATIO | Al CONTENT OF INTERNAL ELECTRODE (atm%) | Al CONTENT OF INTERMEDIATE CONDUCTOR (atm%) | ESD RESISTANCE (kV) | ENERGY RESISTANCE (J) | EVALUA-TION |
|---|---|---|---|---|---|---|---|---|
| COMPARATIVE EXAMPLE 1 | 0 | 0 | 0 | 0 | 0 | 10 | 0.01 | B |
| COMPARATIVE EXAMPLE 2 | 1 | 0 | 1 | 0 | 0 | 12 | 0.01 | B |
| COMPARATIVE EXAMPLE 3 | 1 | 0 | 1 | 0 | 6 | 18 | 0.03 | B |
| COMPARATIVE EXAMPLE 4 | 1 | 0 | 1 | 0 | 10 | 16 | 0.03 | B |
| COMPARATIVE EXAMPLE 5 | 1 | 0 | 1 | 0 | 0 | 12 | 0.01 | B |
| COMPARATIVE EXAMPLE 6 | 1 | 40 | 0.74 | 0 | 0 | 10 | 0.01 | B |
| COMPARATIVE EXAMPLE 7 | 1 | 80 | 0.5 | 0 | 0 | 8 | 0 | B |
| COMPARATIVE EXAMPLE 8 | 1 | 90 | 0.45 | 0 | 0 | 6 | 0 | B |
| COMPARATIVE EXAMPLE 9 | 1 | −20 | 1.1 | 0 | 0 | 10 | 0.01 | B |
| COMPARATIVE EXAMPLE 10 | 1 | −40 | 1.3 | 0 | 0 | 8 | 0 | B |
| COMPARATIVE EXAMPLE 11 | 1 | 90 | 0.45 | 0 | 0.5 | 18 | 0.02 | B |
| COMPARATIVE EXAMPLE 12 | 1 | −20 | 1.1 | 0 | 0.5 | 10 | 0.01 | B |
| COMPARATIVE EXAMPLE 13 | 1 | −40 | 1.3 | 0 | 0.5 | 8 | 0 | B |
| COMPARATIVE EXAMPLE 14 | 1 | 0 | 1 | 1.0 | 0.5 | 16 | 0.02 | B |

METHOD FOR PRODUCING CHIP VARISTOR AND CHIP VARISTOR

BACKGROUND OF THE INVENTION

Field of the Invention

One aspect of the present invention relates to a method for producing a chip varistor. Another aspect of the present invention relates to a chip varistor.

Description of Related Art

Known chip varistors include an element body that exhibits varistor characteristics and first and second internal electrodes arranged in the element body to oppose each other (see, for example, Japanese Unexamined Patent Publication No. 2007-13215). Japanese Unexamined Patent Publication No. 2007-13215 also discloses a method for producing a chip varistor.

SUMMARY OF THE INVENTION

In chip varistors, it is required to have an improved resistance to electro static discharge (ESD) (hereinafter referred to as an "ESD resistance"). A chip varistor with an improved ESD resistance is used as an effective protection element for an electronic circuit, and for example, stably operates a high-speed communication network system based on the recent Ethernet (registered trademark) standard.

An object of one aspect of the present invention is to provide a method for producing a chip varistor with an improved ESD resistance. An object of another aspect of the present invention is to provide a chip varistor with an improved ESD resistance.

A method for producing a chip varistor according to one aspect includes preparing a green body to be an element body that exhibits varistor characteristics, and firing the green body. When preparing the green body, the green body includes first and second internal electrode patterns containing a first electrically conductive material and an intermediate conductor pattern containing a second electrically conductive material different from the first electrically conductive material, inside the green body. The first and second internal electrode patterns oppose each other. The intermediate conductor pattern is separated from the first and second internal electrode patterns in a direction in which the first and second internal electrode patterns oppose each other, and at least a part of the intermediate conductor pattern is located between the first and second internal electrode patterns. The second electrically conductive material contained in the intermediate conductor pattern is diffused into the green body to form a low resistance region in which the second electrically conductive material is diffused, when the green body becomes the element body, the first and second internal electrode patterns become first and second internal electrodes containing the first electrically conductive material, and the intermediate conductor pattern becomes an intermediate conductor containing the second electrically conductive material, through firing of the green body.

According to the one aspect, the chip varistor including the element body is obtained, the element body including the region located between the first and second internal electrodes in a direction in which the first and second internal electrodes oppose each other, in which the second electrically conductive material contained in the intermediate conductor pattern is diffused. In the obtained chip varistor, the region in which the second electrically conductive material contained in the intermediate conductor pattern is diffused has a lower resistance than the region in which the second electrically conductive material is not diffused. The obtained chip varistor has an improved ESD resistance.

In the one aspect, a ratio of an area of at least the part of the intermediate conductor pattern to an area of a region in which the first internal electrode pattern and the second internal electrode pattern overlap each other in the direction in which the first and second internal electrode patterns oppose each other may be 0.5 to 1.0.

When the ratio is 0.5 to 1.0, the second electrically conductive material contained in the intermediate conductor pattern is surely diffused in the region located between the first and second internal electrodes in a direction in which the first and second internal electrodes oppose each other. The obtained chip varistor surely has the improved ESD resistance.

A chip varistor according to another aspect includes an element body that exhibits varistor characteristics, first and second internal electrodes which contain a first electrically conductive material, and an intermediate conductor which contains a second electrically conductive material different from the first electrically conductive material. The first and second internal electrodes are disposed in the element body to oppose each other. The intermediate conductor is separated from the first and second internal electrodes in a direction in which the first and second internal electrodes oppose each other, and is disposed between the first and second internal electrodes. At least a part of the intermediate conductor overlaps the first and second internal electrodes in the direction in which the first and second internal electrodes oppose each other. The element body includes a low resistance region in which the second electrically conductive material is diffused. The low resistance region is located between the first and second internal electrodes in the direction in which the first and second internal electrodes oppose each other.

According to the other aspect, the region in which the second electrically conductive material is diffused has a lower resistance than the region in which the second electrically conductive material is not diffused. The other aspect has an improved ESD resistance.

In the other aspect, a ratio of an area of at least the part of the intermediate conductor to an area of a region in which the first internal electrode and the second internal electrode overlap each other in the direction in which the first and second internal electrodes oppose each other may be 0.5 to 1.0.

In the configuration in which the ratio is 0.5 to 1.0, the second electrically conductive material is surely diffused in the region located between the first and second internal electrodes in the direction in which the first and second internal electrodes oppose each other. This configuration surely has the improved ESD resistance.

In the other aspect, the first and second internal electrodes may include a second electrically conductive material.

In the configuration in which the first and second internal electrodes include the second electrically conductive material, the second electrically conductive material is surely diffused in the region located between the first and second internal electrodes in the direction in which the first and second internal electrodes oppose each other. This configuration surely has the improved ESD resistance.

In the other aspect, a content of the second electrically conductive material in the intermediate conductor may be equal to or larger than a content of the second electrically conductive material in each of the first and second internal electrodes.

In the configuration in which the content of the second electrically conductive material in the intermediate conductor is equal to or larger than the content of the second electrically conductive material in each of the first and second internal electrodes, the second electrically conductive material is more surely diffused in the region located between the first and second internal electrodes in the direction in which the first and second internal electrodes oppose each other. This configuration more surely has the improved ESD resistance.

In the one aspect and the other aspect, the first electrically conductive material may be palladium, and the second electrically conductive material may be aluminum.

The present invention will become more fully understood from the detailed description given hereinafter and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating embodiments of the invention, are given by way of illustration only, since various changes and modifications within the spirit and scope of the invention will become apparent to those skilled in the art from this detailed description.

BRIEF DESCRIPTION OF THE DRAWINGS

FIG. 9 is a chart illustrating test results in Examples; and

FIG. 10 is a chart illustrating test results in Comparative Examples.

DETAILED DESCRIPTION OF EMBODIMENTS

Figure 1:
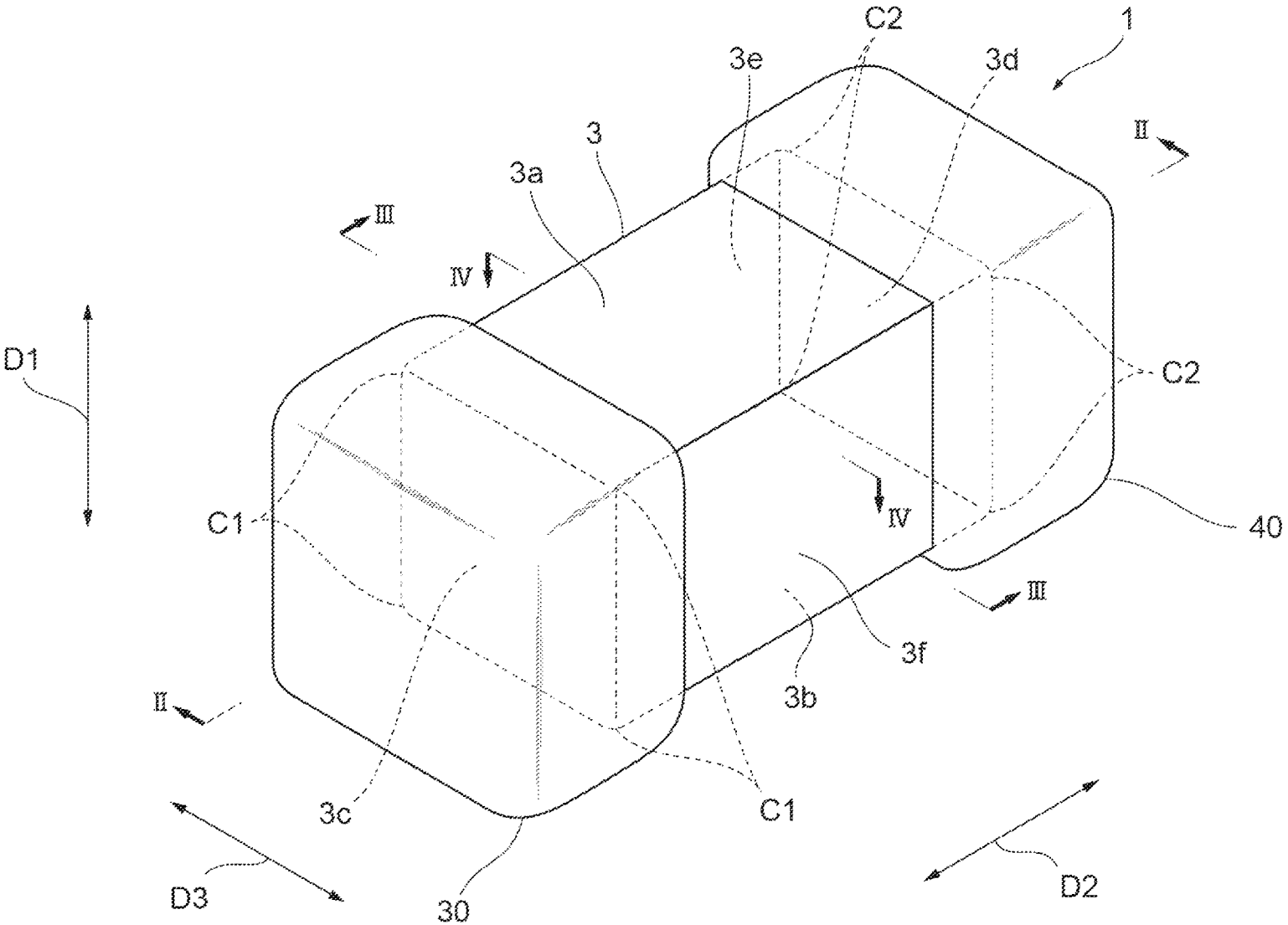
FIG. 1 is a perspective view illustrating a chip varistor according to an embodiment.

Hereinafter, embodiments of the present invention will be described in detail with reference to the accompanying drawings. In the following description, the same elements or elements having the same functions are denoted with the same reference numerals and overlapped explanation is omitted.

Figure 2:
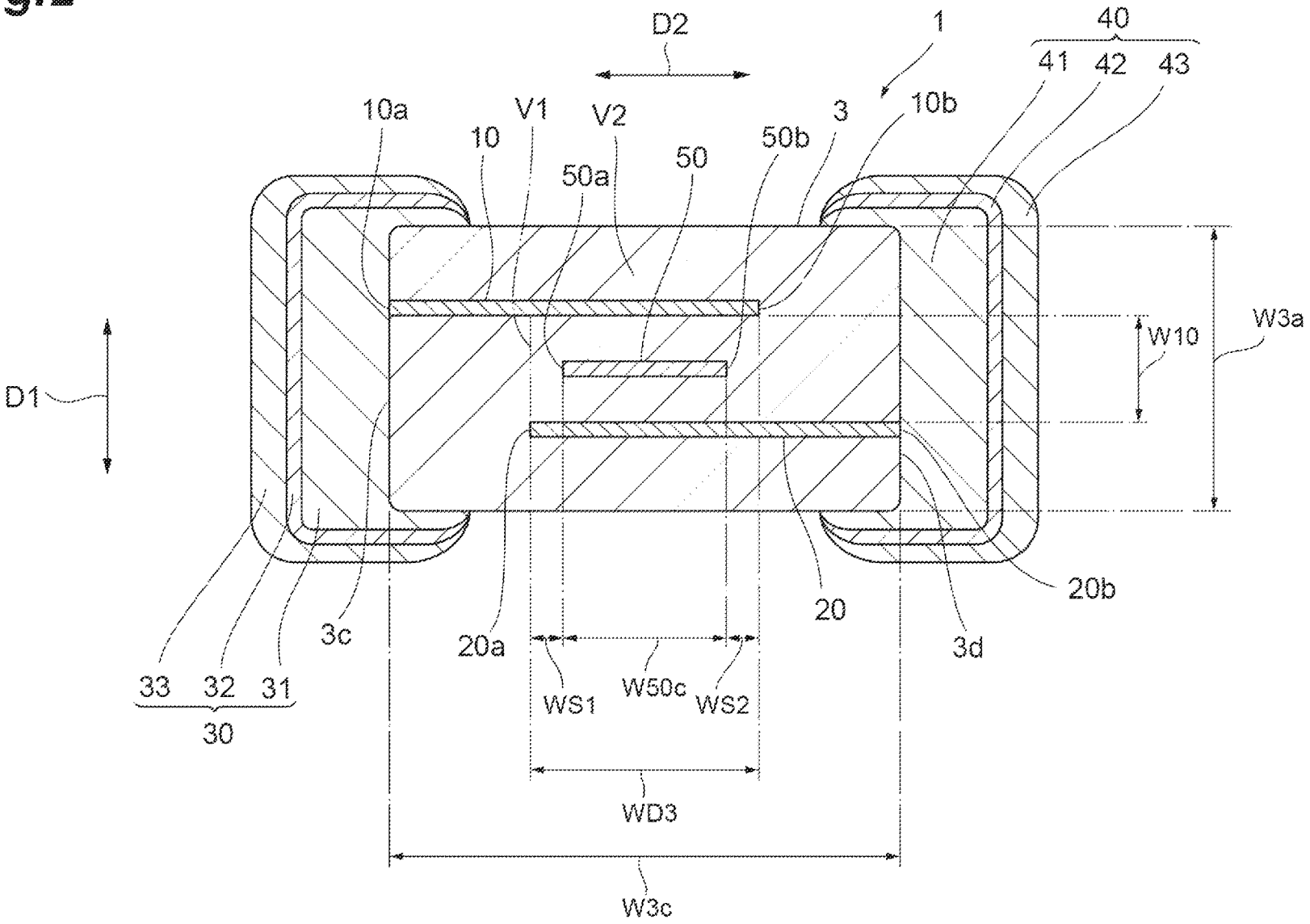
FIG. 2 is a sectional view taken along a line II-II in FIG. 1.
Figure 3:
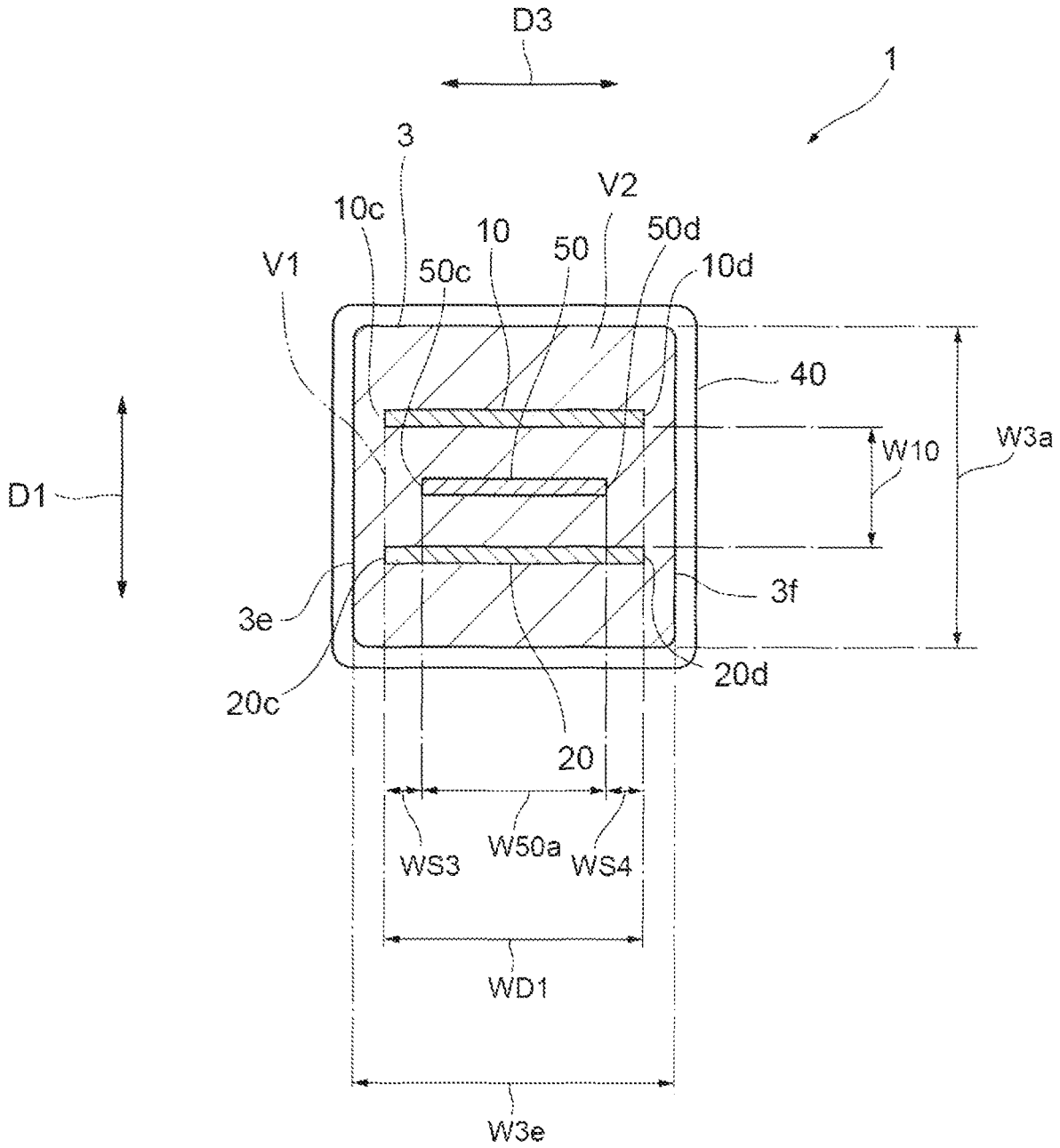
FIG. 3 is a sectional view taken along a line III-III in FIG. 1.
Figure 4:
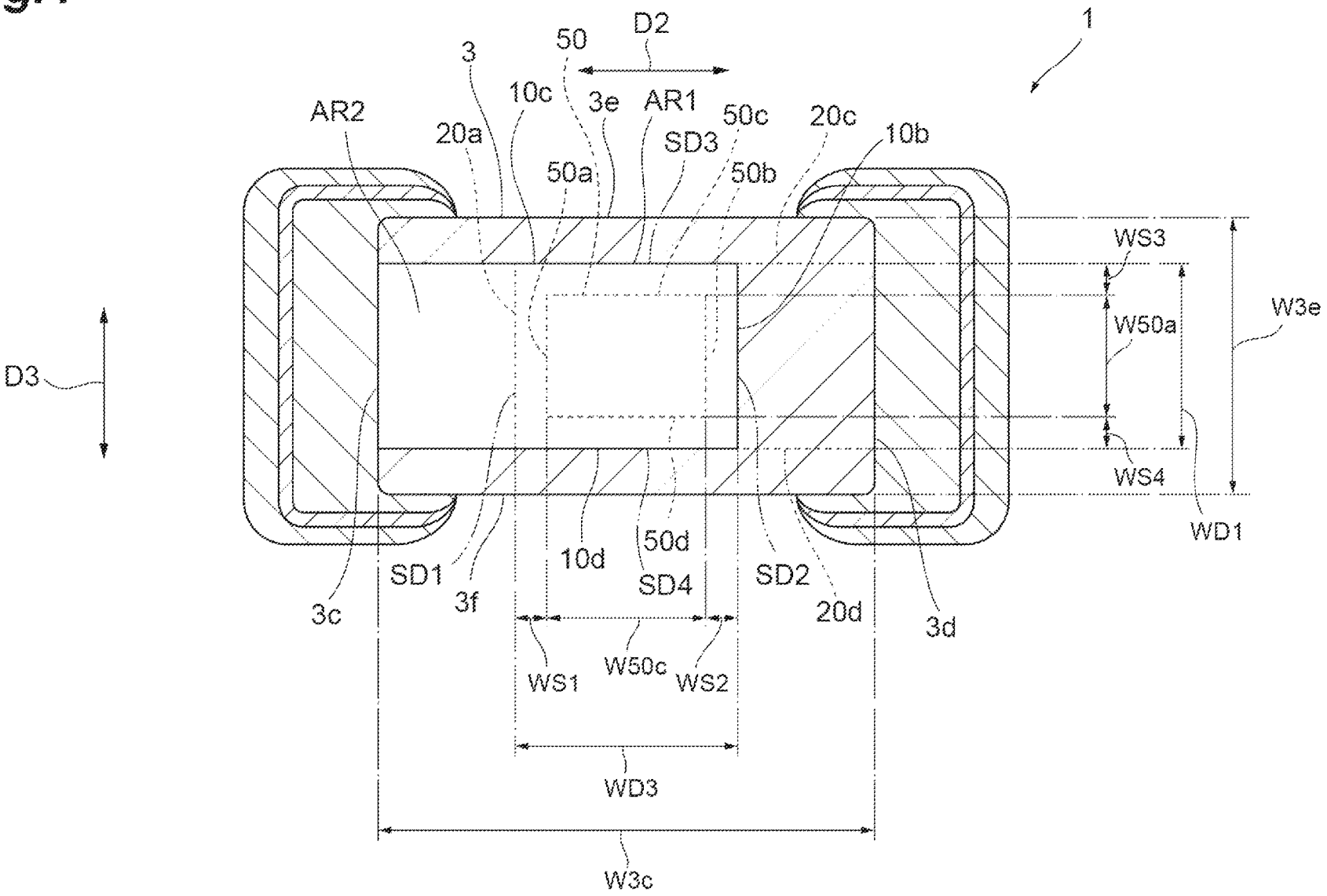
FIG. 4 is a sectional view taken along a line IV-IV in FIG. 1.

First, a configuration of a chip varistor 1 according to the present embodiment will be described with reference to FIGS. 1 to 4. FIG. 1 is a perspective view illustrating the chip varistor according to the present embodiment. FIG. 2 is a sectional view taken along a line II-II in FIG. 1. FIG. 3 is a sectional view taken along a line III-III in FIG. 1. FIG. 4 is a sectional view taken along a line IV-IV in FIG. 1.

The chip varistor 1 includes an element body 3, internal electrodes 10, 20 disposed in the element body 3, and external electrodes 30, 40 disposed on a surface of the element body 3. The element body 3 exhibits varistor characteristics (voltage non-linear characteristics). The internal electrode 20 constitutes a second internal electrode in a case where, for example, the internal electrode 10 constitutes a first internal electrode.

The element body 3 is made of semiconductor ceramic. The element body 3 includes a ceramic element body formed due to laminating of a plurality of varistor layers composed of semiconductor ceramics. In an actual element body 3, each of the varistor layers is integrated to such an extent that a boundary between the varistor layers cannot be visually recognized. In the present embodiment, the plurality of varistor layers are laminated in a first direction D1, for example.

As illustrated in FIGS. 1 to 4, the element body 3 has a rectangular parallelepiped shape. The element body 3 includes a pair of principal surfaces 3*a*, 3*b*, a pair of end surfaces 3*c*, 3*d*, and a pair of side surfaces 3*e*, 3*f*. The principal surfaces 3*a*, 3*b*, the end surfaces 3*c*, 3*d*, and the side surfaces 3*e*, 3*f* constitute the surface of the element body 3. The principal surfaces 3*a*, 3*b* oppose each other in the first direction D1. The end surfaces 3*c*, 3*d* oppose each other in a second direction D2 intersecting the first direction D1. The side surfaces 3*e*, 3*f* oppose each other in a third direction D3 intersecting the first direction D1 and the second direction D2. In the present embodiment, the first direction D1, the second direction D2, and the third direction D3 are orthogonal to each other. The term "rectangular parallelepiped shape" as used herein includes a rectangular parallelepiped shape whose corners and ridges are chamfered, and a rectangular parallelepiped whose corners and ridges are rounded.

In the present embodiment, a length W3*a* of the element body 3 in the first direction D1 is about 0.5 mm, a length W3*c* of the element body 3 in the second direction D2 is about 1.0 mm, and a length W3*e* of the element body 3 in the third direction D3 of is about 0.5 mm. The chip varistor 1 is a so-called 1005 type chip varistor. The chip varistor 1 is not limited to the size of the 1005 type. The chip varistor 1 may have a so-called 1608 size (1.6 mm×0.8 mm×0.8 mm).

The varistor layer contains, for example, as a main component, ZnO (zinc oxide), and as subcomponents, Co, rare earth metal elements, IIIb group elements (B, Al, Ga, In), Si, Cr, Mo, simple metals such as alkali metal elements (K, Rb, Cs) and alkaline earth metal elements (Mg, Ca, Sr, Ba), and oxides thereof. The varistor layer contains, for example, Co, Pr, Cr, Ca, K, Si, and Al as subcomponents.

Next, the internal electrodes 10, 20 will be described. As illustrated in FIGS. 2 and 3, the internal electrodes 10, 20 are disposed in the element body 3 to oppose each other. A direction in which the internal electrodes 10, 20 oppose each other is along the first direction D1. In the present embodiment, the direction in which the internal electrodes 10, 20 oppose each other coincides with the first direction D1. A distance W10 between the internal electrode 10 and the internal electrode 20 is, for example, 0.1 mm.

The internal electrodes 10, 20 include a first electrically conductive material. In the present embodiment, the first electrically conductive material is Pd (palladium). The first electrically conductive material may be Ag, Cu, Au, Pt, or an alloy thereof. The internal electrodes 10, 20 are each configured as, for example, a sintered body of a conductive paste containing the first electrically conductive material. In the present embodiment, the internal electrodes 10, 20 are made of Pd. The thickness of the internal electrodes 10, 20 in the first direction D1 is, for example, 5 μm.

The internal electrodes 10, 20 have a rectangular shape when viewed from the first direction D1. The term "rectangular shape" as used herein includes, for example, a shape in which each corner is chamfered and a shape in which each corner is rounded. In the present embodiment, the internal electrodes 10, 20 have the same shape as each other. As illustrated in FIG. 4, in a case where the internal electrode 10 has a rectangular shape, the length of the internal electrode 10 in the second direction D2 is larger than, for example, the length of the internal electrode 10 in the third direction D3. In this case, the length of the internal electrode 20 in the second direction D2 is larger than, for example, the length of the internal electrode 20 in the third direction D3.

As illustrated in FIG. 2, the internal electrode 10 includes a pair of end edges 10*a*, 10*b* in the second direction D2. The end edge 10*a* is exposed to the end surface 3*c*. The end edge 10*b* is separated from the end surface 3*d*. The end edge 10*b* is not exposed to the end surface 3*d*. The internal electrode 20 includes a pair of end edges 20*a*, 20*b* in the second direction D2. The end edge 20*a* is separated from the end surface 3*c*. The end edge 20*a* is not exposed to the end surface 3*c*. The end edge 20*b* is exposed to the end surface 3*d*.

As illustrated in FIG. 3, the internal electrode 10 includes a pair of sides 10*c*, 10*d* in the third direction D3. The side 10*c* is separated from the side surface 3*e*. The side 10*d* is separated from the side surface 3*f*. The internal electrode 20 includes a pair of sides 20*c*, 20*d* in the third direction D3. The side 20*c* is separated from the side surface 3*e*. The side 20*d* is separated from the side surface 3*f*.

As illustrated in FIG. 4, the internal electrodes 10, 20 include a first region AR1 in which the internal electrode 10 and the internal electrode 20 overlap each other in the first direction D1, and a second region AR2 in which the internal electrode 10 and the internal electrode 20 do not overlap each other in the first direction D1. In the present embodiment, the first region AR1 has a rectangular shape when viewed from the first direction D1. The first region AR1 is defined by virtual lines SD1 to SD4 when viewed from the first direction D1. The virtual lines SD1 and SD2 are virtual lines that define the first region AR1 in the second direction D2. The virtual line SD1 extends along the end edge 20*a*. The virtual line SD2 extends along the end edge 10*b*. The virtual lines SD3 and SD4 define the first region AR1 in the third direction D3. The virtual line SD3 extends along the side 10*c*. The virtual line SD4 extends along the side 10*d*.

In the present embodiment, among the virtual lines SD1 to SD4 that define the rectangular shape of the first region AR1, a length WD1 of the virtual lines SD1 and SD2 is, for example, 0.2 mm, and a length WD3 of the virtual lines SD3 and SD4 is, for example, 0.5 mm. An area of the first region AR1 is, for example, 0.1 $mm^2$.

As illustrated in FIGS. 2 and 3, the element body 3 includes a first element body region V1 sandwiched between the internal electrode 10 and the internal electrode 20 in the first element body region AR1, and a second element body region V2 excluding the first element body region V1. The first element body region V1 is located between the internal electrode 10 and the internal electrode 20 in the first direction D1 in the element body 3. A bottom surface of the first element body region V1 is defined by, for example, a rectangle surrounded by four virtual lines (virtual lines SD1 to SD4) of the first region AR1. A height of the first element body region V1 is defined by, for example, the distance W10 between the internal electrode 10 and the internal electrode 20 in the first direction D1.

Next, the external electrodes 30, 40 will be described. The external electrodes 30, 40 are disposed on the surface of the element body 3. For example, the external electrode 30 is formed to cover the end surface 3*c*, and the external electrode 40 is formed to cover the end surface 3*d*. In the present embodiment, the external electrode 30 is disposed on the end surface 3*c*, and the external electrode 40 is disposed on the end surface 3*d*. The external electrodes 30, 40 oppose each other in the second direction D2.

As illustrated in FIG. 2, the external electrode 30 includes a first electrode layer 31, a first plating layer 32, and a third plating layer 33. The external electrode 40 includes a second electrode layer 41, a second plating layer 42, and a fourth plating layer 43. The first electrode layer 31 and the second electrode layer 41 are formed on the surface of the element body 3.

The first electrode layer 31 is disposed to cover the end surface 3*c*. A part of the first electrode layer 31 is disposed on the principal surfaces 3*a*, 3*b* and on the side surfaces 3*e*, 3*f* (see FIG. 1). In the present embodiment, the first electrode layer 31 covers four corners C1. The four corners C1 are composed of the end surface 3*c* and four other surfaces (the principal surfaces 3*a*, 3*b* and side surfaces 3*e*, 3*f*). In the end surface 3*c*, each ridge portion connecting the four corner portions C1 to each other is also covered with the first electrode layer 31.

The second electrode layer 41 is disposed to cover the end surface 3*d*. A part of the second electrode layer 41 is disposed on the principal surfaces 3*a*, 3*b* and on the side surfaces 3*e*, 3*f* (see FIG. 1). In the present embodiment, the second electrode layer 41 covers four corners C2. The four corners C2 are composed of the end surface 3*d* and four other surfaces (the principal surface 3*a*, 3*b* and side surface 3*e*, 3*f*). In the end surface 3*d*, each ridge portion connecting the four corners C2 to each other is also covered with the second electrode layer 41.

In the present embodiment, the first electrode layer 31 is connected to the end edge 10*a*. The second electrode layer 41 is connected to the end edge 20*b*. The first and second electrode layers 31, 41 are, for example, sintered electrode layers. The first and second electrode layers 31, 41 are formed from sintering a conductive paste applied to the surface of the element body 3. The conductive paste contains a metal powder such as Ag particles or Ag—Pd alloy particles, a glass component, an alkali metal, and an organic binder.

The first plating layer 32 covers the first electrode layer 31. The second plating layer 42 covers the second electrode layer 41. The first and second plating layers 32, 42 are formed using a plating method. The first and second plating layers 32, 42 are, for example, Ni plating layers, Sn plating layers, Cu plating layers, or Au plating layers.

The third plating layer 33 covers the first plating layer 32 and constitutes the outermost layer of the external electrode 30. The fourth plating layer 43 covers the second plating layer 42 and constitutes the outermost layer of the external electrode 40. The third and fourth plating layers 33, 43 are formed using, for example, a plating method. The third and fourth plating layers 33, 43 are, for example, Sn plating layers, Sn—Ag alloy plating layers, Sn—Bi alloy plating layers, or Sn—Cu alloy plating layers.

Next, an intermediate conductor 50 will be described. The chip varistor 1 includes the intermediate conductor 50. The intermediate conductor 50 is separated from the internal electrodes 10, 20 in the first direction D1 and is disposed between the internal electrode 10 and the internal electrode 20. In the present embodiment, the internal electrode 10, the intermediate conductor 50, and the internal electrode 20 are disposed in this order in the first direction D1. The intermediate conductor 50 has, for example, a rectangular shape when viewed from the first direction D1. As illustrated in FIG. 4, in a case where the intermediate conductor 50 has a rectangular shape, the length of the intermediate conductor 50 in the second direction D2 is larger than, for example, the length of the intermediate conductor 50 in the third direction D3.

As illustrated in FIG. 2, the intermediate conductor 50 includes a pair of end edges 50*a*, 50*b* in the second direction D2. The end edge 50*a* is separated from the end surface 3*c*. The end edge 50*a* is separated also from the external electrode 30. The end edge 50*b* is separated from the end surface 3*d*. The end edge 50*b* is separated also from the external electrode 40. As illustrated in FIG. 3, the intermediate conductor 50 includes a pair of sides 50*c*, 50*d* in the third direction D3. The side 50*c* is separated from the side surface 3*e*. The side 50*d* is separated from the side surface 3*f*.

As illustrated in FIG. 4, the end edge 50*a* has a first distance WS1 with the virtual line SD1 in the second direction D2. The end edge 50*b* has a second distance WS2 with the virtual line SD2 in the second direction D2. The side 50*c* has a third distance WS3 with the virtual line SD3 in the third direction D3. The side 50*d* has a fourth distance WS4 with the virtual line SD4 in the third direction D3. In a case where the intermediate conductor 50 has a rectangular shape when viewed from the first direction D1, the first distance WS1 and the second distance WS2 are, for example, 0 to 0.08 mm, and the third distance WS3 and the fourth distance WS4 are, for example, 0 to 0.08 mm.

In a case where the intermediate conductor 50 has a rectangular shape when viewed from the first direction D1, the length W50*a* of the end edge 50*a* and the end edge 50*b* in the third direction D3 is, for example, 0.2 mm, and the length W50*c* of the side 50*c* and the side 50*d* in the second direction D2 is, for example, 0.5 mm. The area of the intermediate conductor 50 is, for example, 0.1 $mm^2$.

In the present embodiment, the chip varistor 1 may include a plurality of the intermediate conductors 50. FIGS. 2 to 4 illustrate an example in which the chip varistor 1 includes single intermediate conductor 50. When the chip varistor 1 includes single intermediate conductor 50, the intermediate conductor 50 is located approximately in a middle between the internal electrodes 10, 20 in the first direction D1, for example. When the chip varistor 1 includes the plurality of intermediate conductors 50, the internal electrode 10, the plurality of intermediate conductors 50, and the internal electrode 20 are disposed in this order at substantially equal intervals in the first direction D1, for example.

The intermediate conductor 50 contains, for example, the first electrically conductive material. The intermediate conductor 50 contains a second electrically conductive material different from the first electrically conductive material. The second electrically conductive material has a low resistance, for example, Al (aluminum). The second electrically conductive material may be, for example, Ga or In. The intermediate conductor 50 is configured as a sintered body of a conductive paste containing the first electrically conductive material and the second electrically conductive material. In the present embodiment, the intermediate conductor 50 mainly contains the first electrically conductive material, and the first electrically conductive material contained in the intermediate conductor 50 is Pd. A content of the second electrically conductive material in the intermediate conductor 50 is, for example, larger than 0 atomic % (atm %) and 1.0 atomic % or less. The content of the second electrically conductive material in the intermediate conductor 50 may be, for example, 0.1 atomic % or more and 0.5 atomic % or less. A thickness of the intermediate conductor 50 in the first direction D1 is, for example, 5 μm.

In the present embodiment, at least a part of the intermediate conductor 50 overlaps the internal electrodes 10, 20 when viewed from the first direction D1. That is, at least the part of the intermediate conductor 50 is located in the first region AR1 in the first direction D1. A part of the intermediate conductor 50 may be located in the first region AR1 in the first direction D1, and the entire intermediate conductor 50 may be located in the first region AR1 in the first direction D1. FIG. 4 illustrates an example in which the entire intermediate conductor 50 is located in the first region AR1 in the first direction D1. At least the part of the intermediate conductor 50 is located in the first region AR1 in the first direction D1. A ratio of an area of at least the part of the intermediate conductor 50 to the area of the first region AR1 is, for example, 0.5 to 1.0. In the present embodiment, even when the chip varistor 1 includes the plurality of intermediate conductors 50, at least the part of each intermediate conductor 50 is located in the first region AR1 in the first direction D1.

At least the part of the intermediate conductor 50 is included in the first element body region V1. A part of the intermediate conductor 50 may be located in the first element body region V1, and the entire intermediate conductor 50 may be located in the first element body region V1. The intermediate conductor 50 is configured as, for example, a sintered body of a conductive paste containing the second electrically conductive material. The second electrically conductive material different from the first electrically conductive material is diffused in the first element body region V1. The second electrically conductive material is not diffused in the second element body region V2. The region in which the second electrically conductive material is diffused has a low resistance.

In the present embodiment, in addition to the intermediate conductor 50, the internal electrodes 10, 20 may include the second electrically conductive material having a low resistance in addition to the first electrically conductive material. A content of the second electrically conductive material in the internal electrodes 10, 20 is, for example, 0 atomic % or more and 0.5 atomic % or less. The content of the second electrically conductive material in the internal electrodes 10, 20 may be, for example, 0.1 atomic % or more and 0.5 atomic % or less. The content of the second electrically conductive material in the intermediate conductor 50 may be equal to or larger than the content of the second electrically conductive material in each of the internal electrodes 10, 20.

The effect of the chip varistor 1 according to the present embodiment will be described. In the chip varistor 1, the element body 3 includes the region located between the internal electrodes 10, 20 in the first direction D1, in which the second electrically conductive material contained in the intermediate conductor 50 is diffused. The electric resistance value of the second electrically conductive material is lower than the electric resistance value of the region in which the second electrically conductive material is not diffused. In the chip varistor 1, the region in which the second electrically conductive material is diffused has a lower resistance than the region in which the second electrically conductive material is not diffused. The chip varistor 1 has an improved ESD resistance.

In the chip varistor 1, the ratio of the area of at least the part of the intermediate conductor 50 to the area of the first region AR1 in the first direction D1 is 0.5 to 1.0. In the chip varistor 1, the second electrically conductive material is surely diffused in the region located between the internal electrodes 10, 20 in the first direction D1. As a result, the chip varistor 1 surely has the improved ESD resistance.

In the chip varistor 1, the internal electrodes 10, 20 contain the second electrically conductive material. In the chip varistor 1, the second electrically conductive material is surely diffused in the region located between the internal electrodes 10, 20 in the first direction D1. As a result, the chip varistor 1 surely has the improved ESD resistance.

In the chip varistor 1, the content of the second electrically conductive material in the intermediate conductor 50 is equal to or larger than the content of the second electrically conductive material in each of the internal electrodes 10, 20. In this case, the second electrically conductive material is more surely diffused in the region located between the internal electrodes 10, 20 in the first direction D1. The chip varistor 1 surely has the improved ESD resistance.

Figure 5:
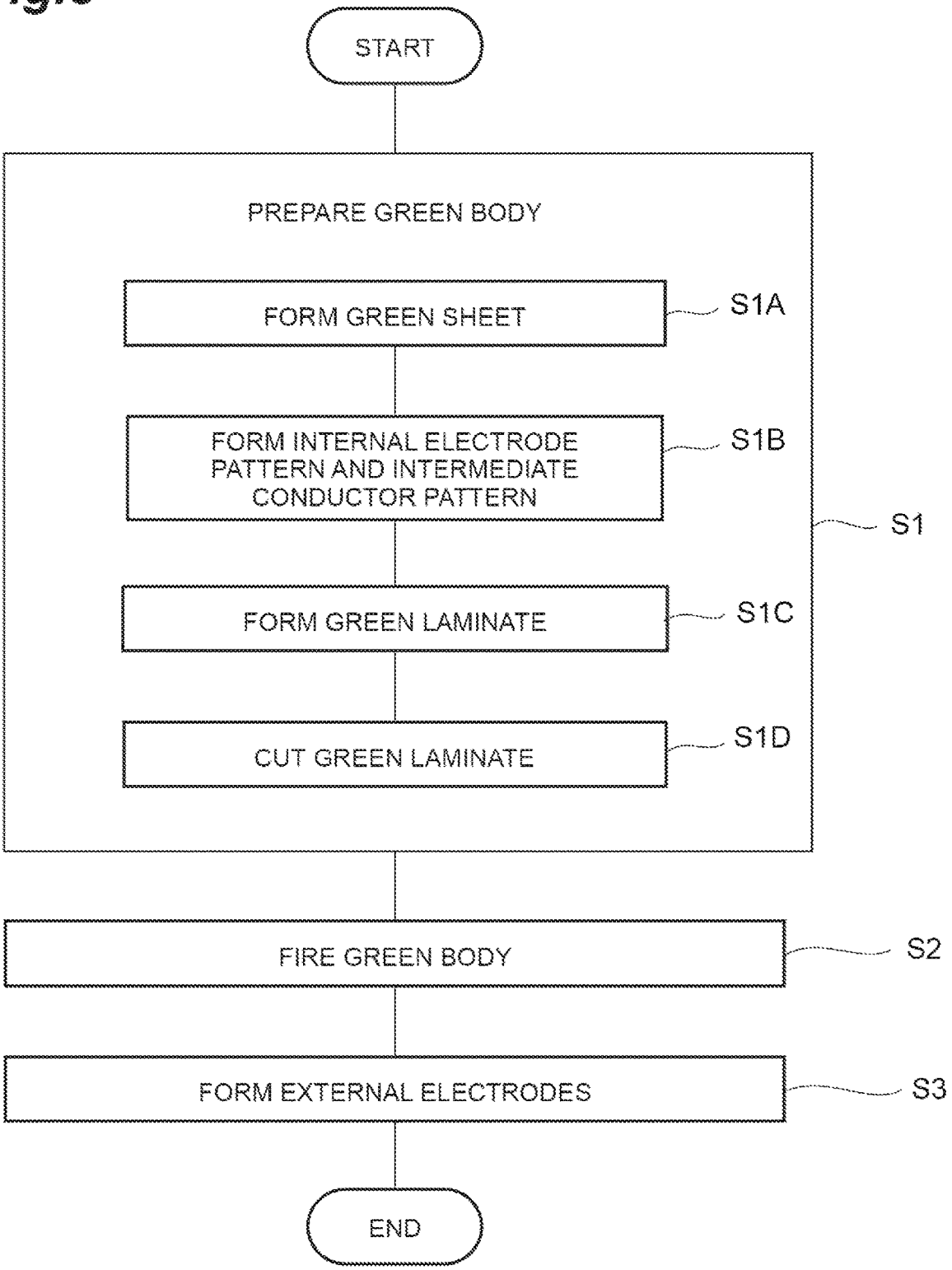
FIG. 5 is a flow chart illustrating a process for producing the chip varistor according to the present embodiment.
Figure 6:
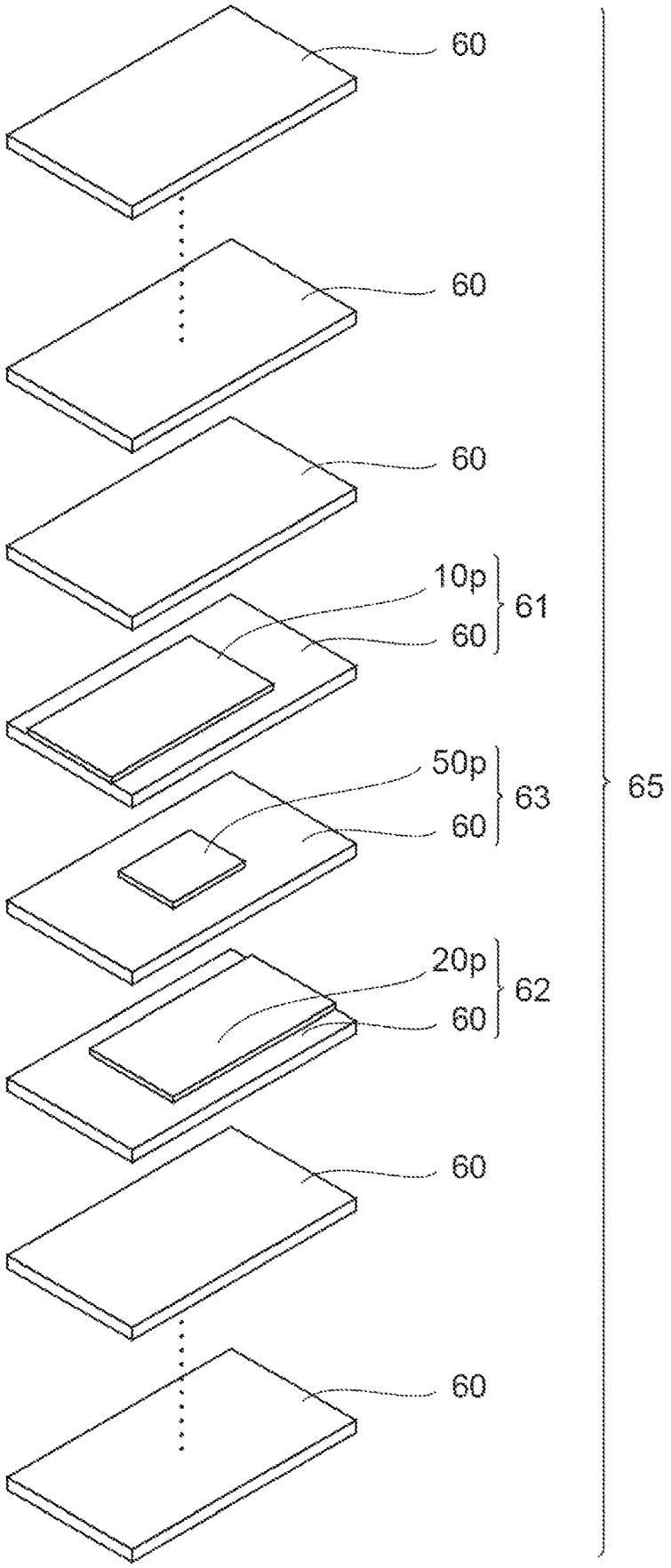
FIG. 6 is a view illustrating the process for producing the chip varistor according to the present embodiment.
Figure 7B:
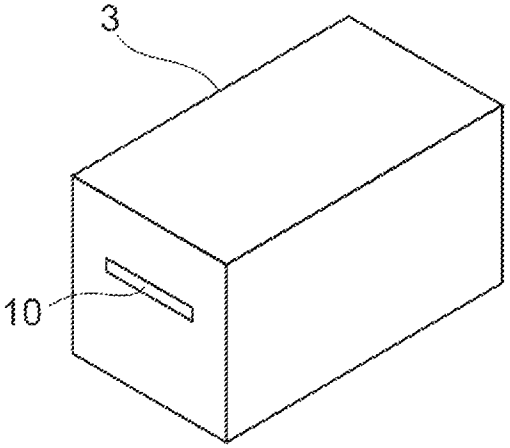
FIGS. 7A to 7C are views illustrating the process for producing the chip varistor according to the present embodiment.
Figure 7A:
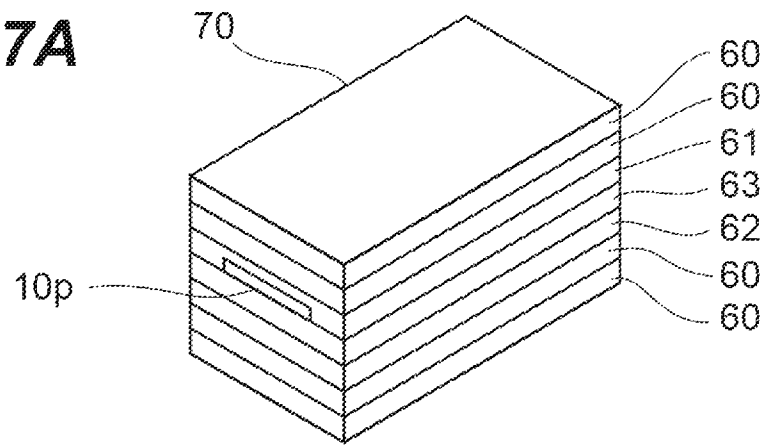
Figure 7C:
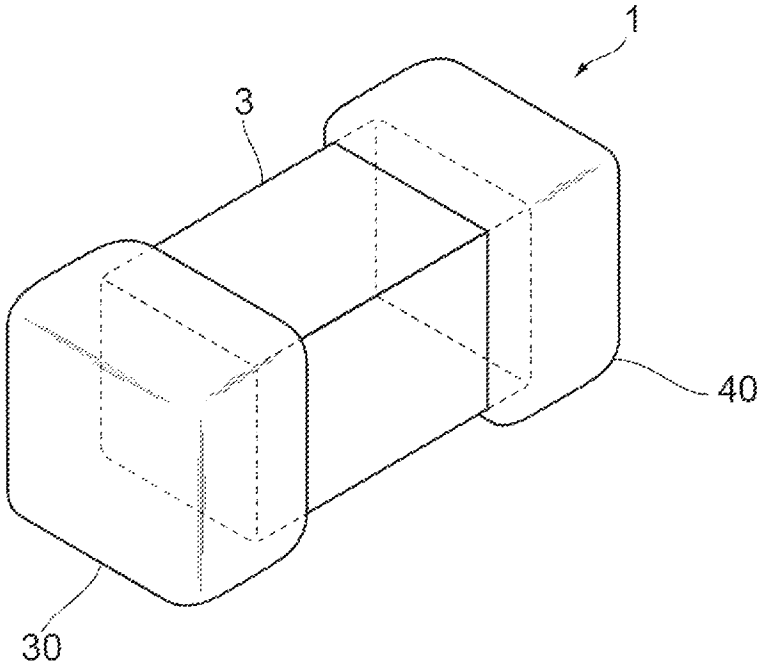
Figure 8:
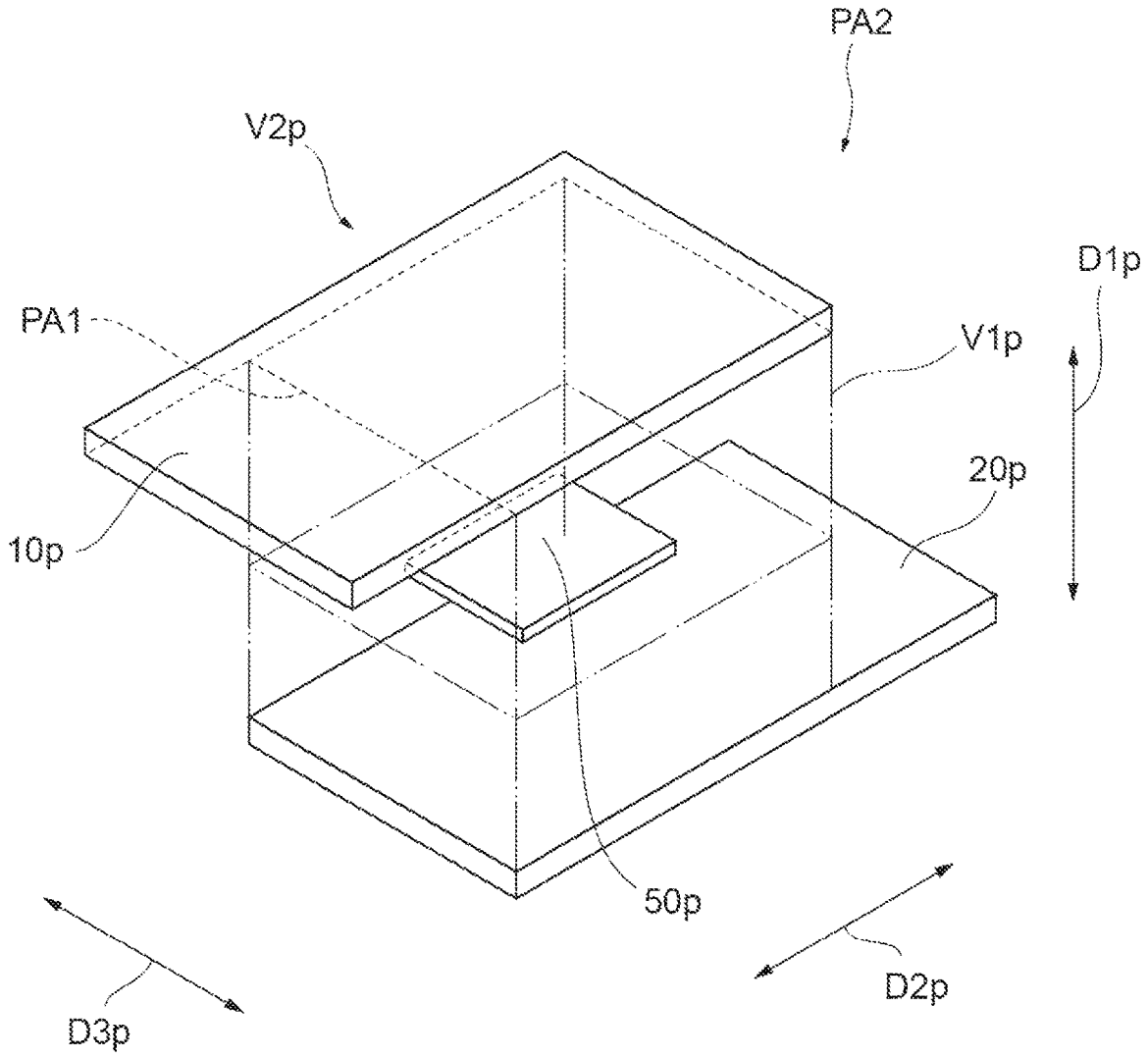
FIG. 8 is a schematic view illustrating the process for producing the chip varistor according to the present embodiment.

Next, processes for producing the chip varistor 1 having the above-described configuration will be described with reference to FIGS. 5 to 8. FIG. 5 is a flow chart illustrating a process for producing the chip varistor according to the present embodiment. FIG. 6 is an exploded perspective view of the element body in the process for producing the chip varistor according to the present embodiment. FIGS. 7A to 7C are views illustrating the process for producing the chip varistor according to the present embodiment. FIG. 8 is a schematic view illustrating the process for producing the chip varistor according to the present embodiment.

As illustrated in FIG. 5, in the process for producing the chip varistor 1, a green body that becomes an element body is prepared (S1), and the green body is fired (S2). The element body exhibits varistor characteristics. When the green body is prepared, first, a green sheet for forming the element body made of semiconductor ceramic is formed (S1A). In the formation of the green sheet, first, a varistor material for the element body is prepared. That is, ZnO as the main component of the varistor layer and trace additives such as metals or oxides of Pr, Co, Cr, Ca, Si, K, and Al as the subcomponents are weighed in a predetermined ratio. After the weighing, each component is mixed to prepare the varistor material. An organic binder, an organic solvent, an organic plasticizer, etc. are added to the varistor material, and these are mixed and ground for about 20 hours to form a slurry. For mixing and grinding, for example, a ball mill is used.

When the green sheet is formed, the slurry is applied onto a base using a method such as a doctor blade method. A film is obtained from the applied slurry. The thickness of the film is, for example, 30 μm. The base is made of, for example, polyethylene terephthalate. The obtained film is peeled from the base to form a green sheet 60.

Next, an internal electrode pattern and an intermediate conductor pattern are formed (S1B). The formation of the internal electrode pattern and the formation of the intermediate conductor pattern may be preceded by the formation of either one, or both patterns may be formed at the same time.

When the internal electrode pattern is formed, a conductive paste in which a metal powder as the first electrically conductive material for the internal electrode, for example, a Pd powder, an organic binder, and an organic solvent are mixed is prepared. The prepared conductive paste is printed on the green sheet 60 using a printing method such as screen printing. The printed conductive paste is dried. Through these processes, the green sheet on which the internal electrode pattern is formed is obtained. In the present embodiment, a green sheet 61 on which an internal electrode pattern 10*p* corresponding to the internal electrode 10 is formed is obtained, and a green sheet 62 on which an internal electrode pattern 20*p* corresponding to the internal electrode 20 is formed is obtained. The internal electrode pattern 20*p* constitutes a second internal electrode pattern in a case where, for example, the internal electrode pattern 10*p* constitutes a first internal electrode pattern. The internal electrode patterns 10*p*, 20*p* contain the first electrically conductive material.

When the intermediate conductor pattern is formed, a metal powder as the first electrically conductive material for the intermediate conductor, for example, a Pd powder, and a metal powder as the second electrically conductive material, for example, an Al powder, an organic binder, and an organic solvent are mixed to prepare a conductive paste for the intermediate conductor. In the conductive paste for the intermediate conductor containing the Pd powder as the first electrically conductive material, a content of the Al powder as the second electrically conductive material is, for example, 10 to 15,000 ppm. The prepared conductive paste for the intermediate conductor is printed on the green sheet 60 using a printing method such as screen printing. The printed conductive paste for the intermediate conductor is dried. Through these processes, a green sheet 63 on which an intermediate conductor pattern 50*p* corresponding to the intermediate conductor 50 is formed is obtained. The intermediate conductor pattern 50*p* contains the first electrically conductive material and the second electrically conductive material different from the first electrically conductive material.

Next, as illustrated in FIG. 6, for example, the green sheet 60 on which the internal electrode pattern and the intermediate conductor pattern are not formed, the green sheet 61 on which the internal electrode pattern 10*p* is formed, the green sheet 63 on which the intermediate conductor pattern 50*p* is formed, the green sheet 62 on which the internal electrode pattern 20*p* is formed, and the green sheet 60 on which the internal electrode pattern and the intermediate conductor pattern are not formed are laminated in this order to form a green laminate 65 (S1C). The green laminate is cut into chips (S1D) to obtain a plurality of green bodies 70 (see FIG. 7A).

As illustrated in FIG. 8, inside the green body 70, the internal electrode patterns 10*p*, 20*p* containing the first electrically conductive material are formed to oppose each other. The intermediate conductor pattern 50*p* is formed to be separated from the internal electrode patterns 10*p*, 20*p* in a first direction D1*p* in which the internal electrode patterns 10*p*, 20*p* oppose each other. The intermediate conductor pattern 50*p* is also formed so that at least a part of the intermediate conductor pattern 50*p* is located between the internal electrode patterns 10*p*, 20*p*. In the present embodiment, the first direction D1*p* coincides with the first direction D1.

The internal electrode patterns 10*p*, 20*p* are formed to include a first pattern region PA1 and a second pattern region PA2. The internal electrode pattern 10*p* and the internal electrode pattern 20*p* overlap each other in the first direction D1*p*, in the first pattern region PA1. The internal electrode pattern 10$p$ and the internal electrode pattern 20$p$ do not overlap each other in the first direction D1$p$, in the second pattern region PA2.

In the present embodiment, at least a part of the intermediate conductor pattern 50$p$ overlaps the internal electrode patterns 10$p$, 20$p$ in the first direction D1$p$. That is, at least the part of the intermediate conductor pattern 50$p$ is located in the first pattern region PA1 in the first direction D1$p$. The part of the intermediate conductor pattern 50$p$ may be located in the first pattern region PA1 in the first direction D1$p$, and the entire intermediate conductor pattern 50$p$ may be located in the first pattern region PA1 in the first direction D1$p$. FIG. 8 illustrates an example in which the entire intermediate conductor pattern 50$p$ is located in the first pattern region PA1 in the first direction D1$p$. At least the part of the intermediate conductor pattern 50$p$ is located in the first pattern region PA1 in the first direction D1$p$. A ratio of an area of at least the part of the intermediate conductor pattern 50$p$ to an area of the first pattern region PA1 is, for example, 0.5 to 1.0.

The green body 70 is prepared to include a first green element body region V1$p$ and a second green element body region V2$p$ excluding the first green element body region V1$p$. The first green element body region V1$p$ is sandwiched between the internal electrode pattern 10$p$ and the internal electrode pattern 20$p$ in the first pattern region PA1 in the first direction D1$p$. That is, the first green element body region V1$p$ is located between the internal electrode patterns 10$p$, 20$p$ in the first direction D1$p$. A bottom surface of the first green element body region V1$p$ is defined by, for example, the first pattern region PA1. A height of the first green element body region V1$p$ is defined by, for example, a distance between the internal electrode pattern 10$p$ and the internal electrode pattern 20$p$. At least the part of the intermediate conductor pattern 50$p$ is included in the first green element body region V1$p$. The part of the intermediate conductor pattern 50$p$ may be located in the first green element body region V1$p$, and the entire intermediate conductor pattern 50$p$ may be located in the first green element body region V1$p$.

In the process for producing the chip varistor 1, the green body 70 is subsequently fired (S2). Through firing of the green body 70, the element body 3 that is a sintered body is prepared (see FIG. 7B). When the green body 70 is fired, for example, a firing treatment is performed after a binder removal treatment. In the binder removal treatment, for example, the green body 70 is heated at 250 to 450° C. for 10 minutes to 8 hours. In the firing treatment, for example, the green body 70 is fired at 1,100 to 1,350° C. for 10 minutes to 8 hours. Through firing, the green sheets become the varistor layers, and the green body 70 becomes the element body 3.

The internal electrode pattern 10$p$ becomes the internal electrode 10 containing the first electrically conductive material, and the internal electrode pattern 20$p$ becomes the internal electrode 20 containing the first electrically conductive material. The intermediate conductor pattern 50$p$ becomes the intermediate conductor 50 containing the first electrically conductive material and the second electrically conductive material. In the firing of the green body 70, when the intermediate conductor pattern 50$p$ becomes the intermediate conductor 50, the second electrically conductive material contained in the intermediate conductor pattern 50$p$ is diffused into the green body 70. As a result of this diffusion, the region in which the second electrically conductive material is diffused has a lower resistance than the region in which the second electrically conductive material is not diffused. In the present embodiment, the second electrically conductive material is diffused in the first green element body region V1$p$. As a result of diffusing the second electrically conductive material, the first element body region V1 has a lower resistance than that in the region in which the second electrically conductive material is not diffused. When Pd is used as the first electrically conductive material and Al is used as the second electrically conductive material, a content of the second electrically conductive material in the first electrically conductive material is, for example, 0.1 to 5 atomic %.

In the process for producing the chip varistor 1, the external electrodes 30, 40 are subsequently formed on the surface of the element body 3 (S3). A conductive paste for the first electrode layer 31 is applied to the end surface 3$c$ and sintered. A conductive paste for the second electrode layer 41 is applied to the end surface 3$d$ and sintered. As a result, the first electrode layer 31 and the second electrode layer 41 are formed. When the conductive paste is applied, the conductive paste is applied so that the conductive paste is in contact with the internal electrode 10 at the end surface 3$c$. Then, the applied conductive paste is dried. The conductive paste is applied so that the conductive paste is in contact with the internal electrode 20 at the end surface 3$d$. Then, the applied conductive paste is dried. After drying, for example, a heat treatment is performed at 650 to 950° C., and the conductive paste is sintered onto the element body 3. The heat treatment time (holding time) is, for example, 10 minutes to 3 hours.

In the conductive pastes for the external electrodes 30, 40, a metal powder, a glass component, an alkali metal, an organic binder, and an organic solvent are mixed. The metal powder is, for example, Ag—Pd alloy particles or a metal powder containing Ag particles as a main component. The glass component is, for example, a glass frit containing $B_2O_3$—SiO—ZnO-based glass as a main component. A content of the glass component contained in the conductive paste is, for example, about 2 to 8% by mass in a case where the entire conductive paste is 100% by mass. A content of the metal powder contained in the conductive paste is, for example, about 60 to 80% by mass in a case where the entire conductive paste is 100% by mass.

Next, a Ni plating layer and a Sn plating layer are sequentially laminated on the first electrode layer 31 to form the first plating layer 32 and the third plating layer 33. A Ni plating layer and a Sn plating layer are sequentially laminated on the second electrode layer 41 to form the second plating layer 42 and the fourth plating layer 43 (see FIG. 2). In this manner, the chip varistor 1 (see FIG. 7C) is obtained. In Ni plating, for example, a Ni plating bath such as a Watt bath is performed using a barrel plating method. In Sn plating, for example, a Sn plating bath such as a neutral Sn plating bath is performed using a barrel plating method.

The effect of the process for producing the chip varistor 1 according to the present embodiment will be described. In the present embodiment, the chip varistor 1 including the element body 3 is obtained, the element body 3 including the region located between the internal electrodes 10, 20 in the first direction D1 in which the internal electrodes 10, 20 oppose each other, in which the second electrically conductive material contained in the intermediate conductor pattern 50$p$ is diffused. In the chip varistor 1, the region in which the second electrically conductive material contained in the intermediate conductor pattern 50$p$ is diffused has a lower resistance than the region in which the second electrically conductive material is not diffused. The chip varistor 1 has the improved ESD resistance.

In the process for producing the chip varistor 1, the ratio of the area of at least a part of the intermediate conductor pattern 50*p* to the area of the first pattern region PA1 in the first direction D1*p* is 0.5 to 1.0. In this case, the second electrically conductive material contained in the intermediate conductor pattern 50*p* is surely diffused in the region located between the internal electrodes 10, 20 in the first direction D1. The chip varistor 1 surely has the improved ESD resistance.

EXAMPLES

Hereinafter, a method for producing a chip varistor and a chip varistor will be further described by way of Examples and Comparative Examples of the present invention. The present invention is not limited to the following examples.

Example 1

Production of Chip Varistor

Process for producing a chip varistor according to Example 1 are as follows.

First, a slurry containing a ZnO varistor material is prepared. With the doctor blade, the slurry is applied onto a base made of polyethylene terephthalate to form a film. The film thickness is 30 μm. The formed film is peeled from the base to form a green sheet.

Next, in order to form an internal electrode pattern, a conductive paste in which a Pd powder as a first electrically conductive material, an organic binder, and an organic solvent are mixed is prepared. This conductive paste is applied onto the green sheet using screen printing. The conductive paste applied on the green sheet is dried. After the conductive paste is dried, the green sheet on which the internal electrode pattern is formed is prepared.

In order to form an intermediate conductor pattern, a Pd powder as the first electrically conductive material for an intermediate conductor, an organic binder, and an organic solvent are mixed, and further, an Al powder as a second electrically conductive material is mixed. From mixing these, a conductive paste for the intermediate conductor is formed. The conductive paste for the intermediate conductor is applied onto a green sheet using screen printing. The conductive paste for the intermediate conductor applied on the green sheet is dried. After the conductive paste for the intermediate conductor is dried, the green sheet on which the intermediate conductor pattern corresponding to the intermediate conductor is formed is obtained.

Next, a green sheet on which the internal electrode pattern and the intermediate conductor pattern are not formed, the green sheet on which the internal electrode pattern is formed, the green sheet on which the intermediate conductor pattern is formed, the green sheet on which the internal electrode pattern is formed, and a green sheet on which the internal electrode pattern and the intermediate conductor pattern are not formed are laminated in this order to form a green laminate. Further, the green laminate is cut into chips to obtain a plurality of divided green bodies.

Subsequently, the green body is subjected to a binder removal treatment and a firing treatment to prepare an element body which is a sintered body. In the binder removal treatment, the green body is heated at 400° C. for 60 minutes. In the firing treatment, the green body is fired at 1,200° C. for 30 minutes. From firing, internal electrodes and the intermediate conductor are obtained in the element body. The content of Al at the internal electrode is 0 atomic %, and the content of Al at the intermediate conductor is 0.1 atomic %.

Subsequently, in order to form external electrodes on the end surfaces of the element body, a conductive paste containing Ag particles is applied, and the applied conductive paste is dried. After that, a heat treatment is performed at 650° C., and the conductive paste is sintered onto the element body to form first and second electrode layers. The heat treatment time (holding time) is 10 minutes. Next, Ni plating and Sn plating are performed, and first and third plating layers are formed on the first electrode layer in this order. Second and fourth plating layers are formed on the second electrode layer in this order. The external electrodes are obtained from forming the electrode layers and the plating layers described above. In Example 1, the chip varistor is produced through the above process.

In Example 1, the size of the chip varistor is as follows. The element body has a rectangular parallelepiped shape, and the internal electrodes and the intermediate conductor viewed from the first direction have a rectangular shape. In the description of each size in Example 1, the same reference numerals as those illustrated in FIGS. 2 to 4 are used. In the element body 3, the length W3*a* is 450 μm, the length W3*c* is 950 μm, and the length W3*e* is 450 μm. The size of the element body in each of Examples and Comparative Examples below is the same as the size of the element body 3 in Example 1.

The distance W10 is 100 μm. The length WD1 is 0.2 mm and the length WD3 is 0.5 mm. The area of the first region AR1 is 0.1 $mm^2$.

In Example 1, the number of the intermediate conductor is one, and the intermediate conductor is located in the middle of the pair of internal electrodes in the first direction D1. In Example 1, the first distance WS1, the second distance WS2, the third distance WS3, and the fourth distance WS4 are equal to each other. Also in Examples and Comparative Examples below, the first distance WS1, the second distance WS2, the third distance WS3, and the fourth distance WS4 are equal to each other. In Example 1, the first distance WS1, the second distance WS2, the third distance WS3, and the fourth distance WS4 are 0 mm. The intermediate conductor is located in the first body region. The area of the intermediate conductor viewed from the first direction D1 is 0.1 $mm^2$. The ratio of the area of the intermediate conductor to the area of the first region in the first direction D1 is 1.0. When the area ratio is 1.0, the area of the intermediate conductor and the area of the first region are equal to each other in the first direction D1. When the area ratio is 0.5, the area of the intermediate conductor is half the area of the first region in the first direction D1.

ESD Resistance Test

The procedure of the ESD resistance test is as follows.

In Example 1, the electrostatic discharge immunity test defined in the IEC (International Electrotechnical Commission) standard IEC61000-4-2 is performed. In a state in which a tip of a discharge gun is in contact with the chip varistor, the discharge voltage (applied voltage) is changed in 2 kV steps, and ten contact discharges are conducted in each step. In Example 1, the ESD resistance is estimated as a voltage value (kV) immediately before the rate of change of the varistor voltage change with respect to the initial value of the varistor voltage after discharge changes by 10% or more.

Energy Resistance Test

The procedure of the energy resistance test is as follows. An impulse current of 10/1,000 μs is applied to the chip varistor, and the electrical characteristics of the chip varistor are measured. In Example 1, the energy resistance is estimated as the maximum energy value (J) in which the impulse current is applied once and the electrical characteristics of the chip varistor are not deteriorated.

Example 2

In Example 2, a chip varistor is prepared and tested in the same manner as in Example 1 except that the content of Al in the intermediate conductor is 0.5 atomic %.

Example 3

In Example 3, a chip varistor is prepared and tested in the same manner as in Example 1 except that the content of Al in the intermediate conductor is 1 atomic %.

Example 4

In Example 4, a chip varistor is prepared and tested in the same manner as in Example 1 except that the content of Al in the intermediate conductor is 3 atomic %.

Example 5

In Example 5, a chip varistor is prepared and tested in the same manner as in Example 1 except that the content of Al in the intermediate conductor is 5 atomic %.

Example 6

In Example 6, a chip varistor is prepared and tested in the same manner as in Example 1 except that the content of Al in the intermediate conductor is 0.5 atomic %.

Example 7

In Example 7, a chip varistor is prepared and tested in the same manner as in Example 6 except that the first distance is 40 μm, that is, the ratio of the area of the intermediate conductor to the area of the first region is 0.74.

Example 8

In Example 8, a chip varistor is prepared and tested in the same manner as in Example 6 except that the first distance is 80 μm, that is, the area ratio is 0.5.

Example 9

In Example 9, a chip varistor is prepared and tested in the same manner as in Example 1 except that the content of Al in the intermediate conductor is 0.5 atomic %.

Example 10

In Example 10, a chip varistor is prepared and tested in the same manner as in Example 9 except that the number of intermediate conductors is two. In Example 10, the two intermediate conductors are disposed at equal intervals in the first direction between the first and second internal electrodes.

Example 11

In Example 11, a chip varistor is prepared and tested in the same manner as in Example 9 except that the number of intermediate conductors is three. In Example 11, the three intermediate conductors are disposed at equal intervals in the first direction between the first and second internal electrodes.

Example 12

In Example 12, a chip varistor is prepared and tested in the same manner as in Example 1 except that the content of Al in the internal conductor is 0.5 atomic % and the content of Al in the intermediate conductor is 1.0 atomic %.

Example 13

In Example 13, a chip varistor is prepared and tested in the same manner as in Example 12 except that the content of Al in the internal conductor is 0.5 atomic % and the content of Al in the intermediate conductor is 0.5 atomic %.

Comparative Example 1

In Comparative Example 1, a chip varistor is prepared and tested in the same manner as in Example 1 except that the intermediate conductor is not provided.

Comparative Example 2

In Comparative Example 2, a chip varistor is prepared and tested in the same manner as in Example 1 except that the content of Al in the intermediate conductor is 0 atomic %, that is, the intermediate conductor does not contain the second electrically conductive material.

Comparative Example 3

In Comparative Example 3, a chip varistor is prepared and tested in the same manner as in Example 1 except that the content of Al in the intermediate conductor is 6 atomic %.

Comparative Example 4

In Comparative Example 4, a chip varistor is prepared and tested in the same manner as in Example 1 except that the content of Al in the intermediate conductor is 10 atomic %.

Comparative Example 5

In Comparative Example 5, a chip varistor is prepared and tested in the same manner as in Example 1 except that the content of Al in the intermediate conductor is 0 atomic %, that is, the intermediate conductor does not contain the second electrically conductive material.

Comparative Example 6

In Comparative Example 6, a chip varistor is prepared and tested in the same manner as in Comparative Example 5 except that the first distance is 40 μm, that is, the ratio of the area of the intermediate conductor to the area of the first region is 0.74.

Comparative Example 7

In Comparative Example 7, a chip varistor is prepared and tested in the same manner as in Comparative Example 5 except that the first distance is 80 μm, that is, the area ratio is 0.5.

Comparative Example 8

In Comparative Example 8, a chip varistor is prepared and tested in the same manner as in Comparative Example 5 except that the first distance is 90 μm, that is, the area ratio is 0.45.

Comparative Example 9

In Comparative Example 9, a chip varistor is prepared and tested in the same manner as in Comparative Example 5 except that the first distance is −20 μm. In a case where the first distance is a negative value, the intermediate conductor 50 extends outside the first region in the first and second internal electrodes in the second direction. In Comparative Example 9, the end edges of the intermediate conductor are located outside the first region and away from the first region by 20 μm on both sides of the first region in the second direction when viewed from the first direction. The end edges of the intermediate conductor are located outside the first region and away from the first region by 20 μm also on both sides of the first region in the third direction when viewed from the first direction. In Comparative Example 9, the area ratio is 1.1.

Comparative Example 10

In Comparative Example 10, a chip varistor is prepared and tested in the same manner as in Comparative Example 5 except that the first distance is −40 μm, that is, the area ratio is 1.3.

Comparative Example 11

In Comparative Example 11, a chip varistor is prepared and tested in the same manner as in Example 1 except that the content of Al in the intermediate conductor is 0.5 atomic % and the first distance is 90 μm, that is, the area ratio is 0.45.

Comparative Example 12

In Comparative Example 12, a chip varistor is prepared and tested in the same manner as in Comparative Example 11 except that the first distance is −20 μm, that is, the area ratio is 1.1.

Comparative Example 13

In Comparative Example 13, a chip varistor is prepared and tested in the same manner as in Comparative Example 11 except that the first distance is −40 μm, that is, the area ratio is 1.3.

Comparative Example 14

In Comparative Example 14, a chip varistor is prepared and tested in the same manner as in Example 1 except that the content of Al in the internal conductor is 1.0 atomic % and the content of Al in the intermediate conductor is 0.5 atomic %.

FIG. 9 is a chart illustrating the test results in Examples. FIG. 9 is a table illustrating various data of the chip varistors according to Examples, the results of the ESD resistance test and the energy resistance test, and the results of the characteristic evaluation based on these test results. FIG. 10 is a chart illustrating the test results in Comparative Examples. FIG. 10 is a table illustrating various data of the chip varistors according to Comparative Examples, the results of the ESD resistance test and the energy resistance test, and the results of the characteristic evaluation based on these test results. In FIGS. 9 and 10, the data of the chip varistors are the number of intermediate conductors included in the chip varistor, the first distance between the conductor end of the intermediate conductor and the region end of the first region, the ratio of the area of the intermediate conductor to the area of the first region, the Al content (atm %) in the internal electrode, and the Al content (atm %) in the intermediate conductor.

The evaluations in Examples and Comparative Examples are as follows.

In high-speed communication network systems based on the Ethernet standard, it is generally desirable for the chip varistor to have an ESD resistance of a voltage value of 15 kV or more. In the ESD resistance test, in a case where the maximum voltage value indicating the ESD resistance is 20 kV or more, it is judged as "good". In a case where the maximum voltage value indicating the ESD resistance is less than 20 kV, there is not enough margin for the voltage value of 15 kV required for the ESD resistance, and the reliability of the chip varistor becomes insufficient, so that it is judged as "poor".

In high-speed communication network systems based on the Ethernet standard, it is generally desirable that the energy resistance of the chip varistor be 0.03 J or more. In the energy resistance test, in a case where the maximum energy value indicating the energy resistance is 0.03 J or more, it is judged as "good". In a case where the maximum energy value indicating the energy resistance is less than 0.03 J, the reliability of the chip varistor becomes insufficient, and it is judged as "poor".

In FIGS. 9 and 10, in a case where the judgments in the ESD resistance test and the energy resistance test are "good", the characteristic of the chip varistor is evaluated as "A (good)". In a case where the judgment in either the ESD resistance test or the energy resistance test is "poor", the characteristic of the chip varistor is evaluated as "B (poor)".

As illustrated in FIG. 9, in Examples 1 to 5, the intermediate conductor is provided, and the content of Al in the intermediate conductor is 0.1 to 5 atomic %. In Examples 1 to 5, the results of the ESD resistance test and the energy resistance test are judged as "good", and the characteristic of the chip varistor is evaluated as "A (good)".

In Examples 6 to 8, the content of Al in the intermediate conductor is 0.5 atomic %, and the first distance is 0 to 80 μm, that is, the ratio of the area of the intermediate conductor to the area of the first region is 1.0 to 0.5. In Examples 6 to 8, the results of the ESD resistance test and the energy resistance test are judged as "good", and the characteristic of the chip varistor is evaluated as "A (good)".

In Examples 9 to 11, the content of Al in the intermediate conductor is 0.5 atomic %, and the first distance is 0 μm, that is, the area ratio is 1.0. In Examples 9 to 11, the number of intermediate conductors is 1 to 3, and in any of Examples, the results of the ESD resistance test and the energy resistance test are judged as "good". In Examples 9 to 11, the characteristic of the chip varistor is evaluated as "A (good)".

In Examples 12 and 13, the content of Al in the intermediate conductor is larger than the content of Al in the internal electrode (Example 12), or is equivalent to the content of Al in the internal electrode (Example 13). In Examples 12 and 13, the results of the ESD resistance test and the energy resistance test are judged as "good", and the characteristic of the chip varistor is evaluated as "A (good)". Also, in Examples 1 to 5, the content of Al in the intermediate conductor is larger than the content of Al in the internal electrode (conditions other than the content of Al are the same as in Examples 12 and 13), the results of the ESD resistance test and the energy resistance test are judged as "good", and the characteristic of the chip varistor is evaluated as "A (good)".

As illustrated in FIG. 10, in Comparative Examples 1 to 4, when the intermediate conductor is not provided (Comparative Example 1), and when the content of Al in the intermediate conductor is 0 atomic % even if the intermediate conductor is provided (Comparative Example 2), the results of the ESD resistance test and the energy resistance test are all judged as "poor". When the content of Al in the intermediate conductor is 6 and 10 atomic % (Comparative Examples 3 and 4), the results of the ESD resistance test are all judged as "poor". In Comparative Examples 1 to 4, the characteristic of the chip varistor is evaluated as "B (poor)".

In Comparative Examples 5 to 10, the content of Al in the intermediate conductor is 0 atomic %, and the results of the ESD resistance test and the energy resistance test are judged as "poor" regardless of the size of the first distance. In Comparative Examples 5 to 10, the characteristic of the chip varistor is evaluated as "B (poor)".

In Comparative Examples 11 to 13, the first distance is 90 μm, that is, the ratio of the area of the intermediate conductor to the area of the first region is 0.45 (Comparative Example 11), the first distance is −20 μm, that is, the area ratio is 1.1 (Comparative Example 12), or the first distance is −40 μm, that is, the area ratio is 1.3 (Comparative Example 13). In Comparative Examples 11 to 13, the content of Al in the intermediate conductor is 0.5 atomic %, but the results of the ESD resistance test and the energy resistance test are judged as "poor", and the characteristic of the chip varistor is evaluated as "B (poor)".

In Comparative Example 14, the content of Al in the intermediate conductor is smaller than the content of Al in the internal electrode. In Comparative Example 14, the results of the ESD resistance test and the energy resistance test are judged as "poor", and the characteristic of the chip varistor is evaluated as "B (poor)".

Although the embodiment of the present invention has been described above, the present invention is not necessarily limited to the embodiment, and the embodiment can be variously changed without departing from the scope of the invention.

What is claimed is:

1. A method for producing a chip varistor, the method comprising:

preparing a green body to be an element body, the element body exhibiting varistor characteristics; and firing the green body, wherein, when preparing the green body, the green body including, inside the green body, first and second internal electrode patterns containing a first electrically conductive material, the first and second internal electrode patterns opposing each other, and an intermediate conductor pattern containing a second electrically conductive material different from the first electrically conductive material, the intermediate conductor pattern being separated from the first and second internal electrode patterns in a direction in which the first and second internal electrode patterns oppose each other, and at least a part of the intermediate conductor pattern being located between the first and second internal electrode patterns, and the second electrically conductive material contained in the intermediate conductor pattern is diffused into the green body to form a low resistance region in which the second electrically conductive material is diffused, when the green body becomes the element body, the first and second internal electrode patterns become first and second internal electrodes containing the first electrically conductive material, and the intermediate conductor pattern becomes an intermediate conductor containing the second electrically conductive material, through firing of the green body.

2. The method according to claim 1, wherein a ratio of an area of at least the part of the intermediate conductor pattern to an area of a region in which the first internal electrode pattern and the second internal electrode pattern overlap each other in the direction in which the first and second internal electrode patterns oppose each other is 0.5 to 1.0.

3. The method according to claim 1, wherein the first electrically conductive material is palladium, and the second electrically conductive material is aluminum.

4. A chip varistor comprising:

an element body exhibiting varistor characteristics;

first and second internal electrodes containing a first electrically conductive material, the first and second internal electrodes being disposed in the element body to oppose each other; and an intermediate conductor containing a second electrically conductive material different from the first electrically conductive material, the intermediate conductor being separated from the first and second internal electrodes in a direction in which the first and second internal electrodes oppose each other, the intermediate conductor being disposed between the first and second internal electrodes, wherein at least a part of the intermediate conductor overlaps the first and second internal electrodes in the direction in which the first and second internal electrodes oppose each other, and wherein the element body includes a low resistance region in which the second electrically conductive material is diffused, the low resistance region being located between the first and second internal electrodes in the direction in which the first and second internal electrodes oppose each other.

5. The chip varistor according to claim 4, wherein a ratio of an area of at least the part of the intermediate conductor to an area of a region in which the first internal electrode and the second internal electrode overlap each other in the direction in which the first and second internal electrodes oppose each other is 0.5 to 1.0.

6. The chip varistor according to claim 4, wherein the first and second internal electrodes further include the second electrically conductive material.

7. The chip varistor according to claim 6, wherein a content of the second electrically conductive material in the intermediate conductor is equal to or larger than a content of the second electrically conductive material in each of the first and second internal electrodes.

8. The chip varistor according to claim 4, wherein the first electrically conductive material is palladium, and the second electrically conductive material is aluminum.

* * * * *